US006504103B1

(12) United States Patent
Meyer et al.

(10) Patent No.: US 6,504,103 B1
(45) Date of Patent: Jan. 7, 2003

(54) VISUAL LATCHING INDICATOR ARRANGEMENT FOR AN ELECTRICAL BUSHING AND TERMINATOR

(75) Inventors: Andrew Edgar Meyer, Milwaukee, WI (US); Todd Kim Knapp, Waukesha, WI (US); Frank John Muench, Waukesha, WI (US)

(73) Assignee: Cooper Industries, Inc., Houston, TX (US)

( * ) Notice: Subject to any disclaimer, the term of this patent is extended or adjusted under 35 U.S.C. 154(b) by 1077 days.

(21) Appl. No.: 08/821,760

(22) Filed: Mar. 20, 1997

Related U.S. Application Data

(63) Continuation of application No. 08/262,460, filed on Jun. 20, 1994, now abandoned, which is a continuation-in-part of application No. 08/038,335, filed on Mar. 19, 1993, now abandoned.

(51) Int. Cl.[7] ..... H01B 17/58

(52) U.S. Cl. ..... 174/167; 439/489; 439/680; 285/93

(58) Field of Search ..... 174/167; 439/86, 439/88, 181–187, 354, 357, 358, 489, 680, 921; 285/93

(56) References Cited

U.S. PATENT DOCUMENTS

| | | | | |
|---|---|---|---|---|
| 1,783,062 A | | 11/1930 | Trencham | |
| 1,997,081 A | | 4/1935 | Reynolds | |
| 2,605,389 A | | 7/1952 | Kimball | |
| 2,667,532 A | | 1/1954 | Ewer | |
| 2,892,991 A | * | 6/1959 | Beebee et al. | 285/93 X |
| 3,474,386 A | | 10/1969 | Link | |
| 3,509,518 A | | 4/1970 | Phillips | |
| 3,513,425 A | | 5/1970 | Arndt | |
| 3,652,975 A | | 3/1972 | Keto | |
| 3,663,928 A | | 5/1972 | Keto | |
| 3,670,287 A | | 6/1972 | Keto | |
| 3,678,432 A | | 7/1972 | Boliver | |
| 3,720,904 A | | 3/1973 | De Sio | |
| 3,826,860 A | | 7/1974 | De Sio et al. | |
| 3,835,439 A | | 9/1974 | Yonkers | |
| 3,860,322 A | | 1/1975 | Sankey et al. | |
| 3,915,534 A | | 10/1975 | Yonkers | |
| 3,953,099 A | | 4/1976 | Wilson | |

(List continued on next page.)

FOREIGN PATENT DOCUMENTS

| | | | |
|---|---|---|---|
| GB | 2254493 | * 10/1992 | 439/181 |

OTHER PUBLICATIONS

Cooper Power Systems; *The Cooper Pos–Break Elbow Elbow and Cap* (1988).

"Safe–T–Ring™ an anti–vacuum device 9U02Ring"; Internet Advertisement; Chardon Elecrical Componenets; Greeneville, TN; 1988.

*Primary Examiner*—Albert W. Paladini
(74) *Attorney, Agent, or Firm*—Fish & Richardson P.C.

(57) ABSTRACT

An elbow terminator has a socket in which an electrical probe is disposed. The terminator is insertable onto an electrical bushing such that a tongue of the bushing is received in the socket of the terminator, and the probe of the terminator is electrically coupled to a contact sleeve disposed within the tongue. A latching mechanism produces positive latching between the tongue and socket when the tongue has been inserted to a predescribed depth within the socket. In order to enable an operator to visually observe that the tongue has been inserted to the prescribed depth, the bushing carries a color band which becomes completely disposed (invisible) in the socket when positive latching occurs. Alternatively, the bushing can be provided with gauge tabs which become aligned with a witness line formed on the terminator when positive latching occurs.

3 Claims, 3 Drawing Sheets

U.S. PATENT DOCUMENTS

| | | | | |
|---|---|---|---|---|
| 3,955,874 | A | | 5/1976 | Boliver |
| 3,957,332 | A | | 5/1976 | Labert, III |
| 3,960,433 | A | | 6/1976 | Boliver |
| 4,067,636 | A | | 1/1978 | Boliver et al. |
| 4,113,339 | A | * | 9/1978 | Eley ..... 439/183 |
| 4,123,131 | A | | 10/1978 | Pearce, Jr. et al. |
| 4,210,381 | A | | 7/1980 | Borgstrom |
| 4,260,214 | A | | 4/1981 | Dorn |
| H280 | H | | 6/1987 | Thigpen |
| 4,722,694 | A | | 2/1988 | Stepniak |
| 4,793,637 | A | * | 12/1988 | Laipply et al. ..... 285/39 |
| 4,822,291 | A | | 4/1989 | Cunningham |
| 4,863,392 | A | | 9/1989 | Borgstrom et al. |
| 4,867,687 | A | | 9/1989 | Williams et al. |
| 4,972,049 | A | | 11/1990 | Muench |
| 5,213,517 | A | | 5/1993 | Kerek et al. |
| 5,221,220 | A | | 6/1993 | Roscizewski |
| 5,230,640 | A | | 7/1993 | Tardif |
| 5,248,263 | A | | 9/1993 | Sakurai et al. |
| 5,266,041 | A | | 11/1993 | De Luca |
| 5,356,304 | A | | 10/1994 | Colleran |
| 5,358,420 | A | | 10/1994 | Cairns et al. |
| 5,393,240 | A | | 2/1995 | Makal |
| 5,433,622 | A | | 7/1995 | Galambos |
| 5,492,487 | A | | 2/1996 | Cairns et al. |
| 5,641,310 | A | | 6/1997 | Tiberio, Jr. |
| 5,795,180 | A | | 8/1998 | Siebens |
| 5,816,835 | A | | 10/1998 | Meszaros |
| 5,857,862 | A | | 1/1999 | Muench et al. |
| 5,957,712 | A | | 9/1999 | Stepniak |
| 6,168,447 | B1 | | 1/2001 | Stepniak et al. |
| 6,213,799 | B1 | | 4/2001 | Jazowski et al. |

* cited by examiner

FIG. 1
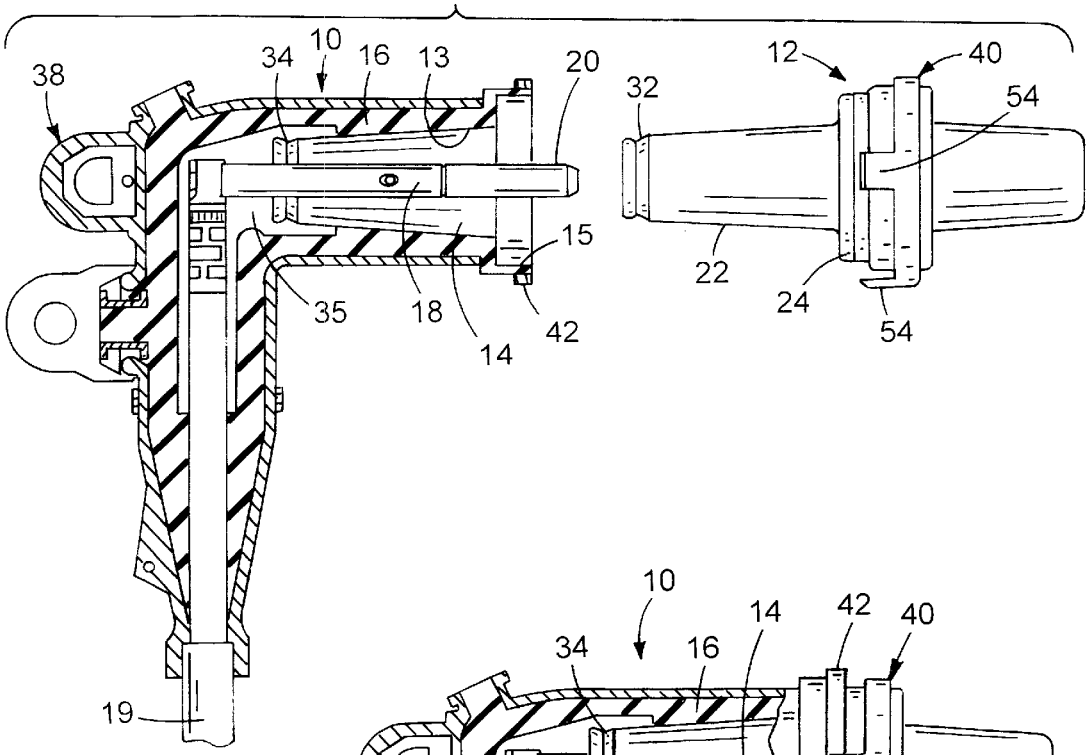
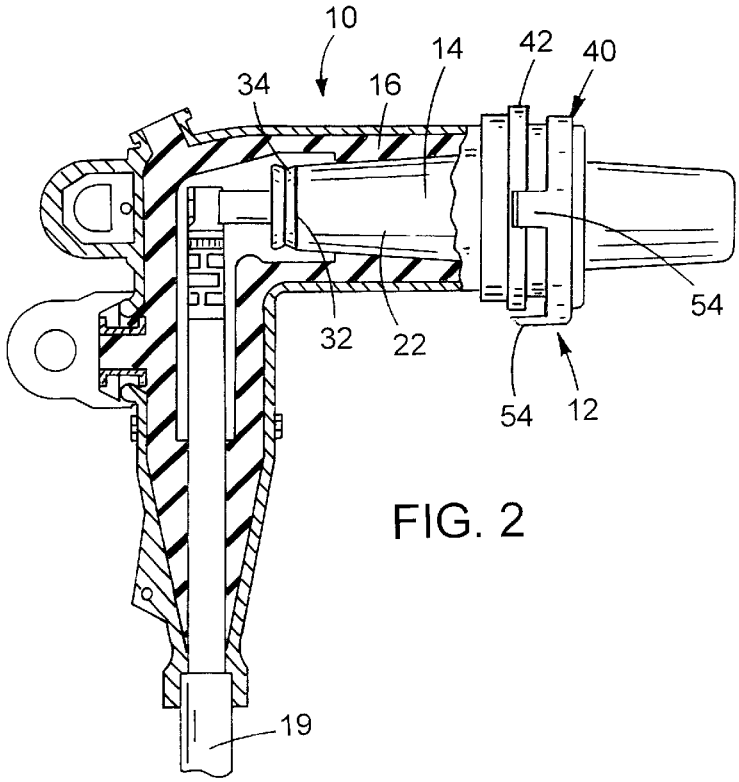
FIG. 2

VISUAL LATCHING INDICATOR ARRANGEMENT FOR AN ELECTRICAL BUSHING AND TERMINATOR

Related Invention

This is a continuation of application Ser. No. 08/262,460, filed Jun. 20, 1994, now abandoned, which, in turn, is a Continuation-in-Part of application Ser. No. 08/038,335 filed Mar. 19, 1993, now abandoned.

BACKGROUND OF THE INVENTION

The present invention relates to the interconnection of electrical distribution elements and, in particular, to the interconnection between a loadbreak elbow terminator and a bushing.

Electrical distribution equipment, such as a deadfront switch gear arrangement, typically includes fixed electrical bushings which are to be connected to external electrical cables. The fixed bushings are mounted in a wall of the electrical equipment and have their outer ends arranged to be connected to the cables.

One way of achieving this connection is by inserting an elbow terminator onto the bushing, the terminator being coupled to the cable. The elbow terminator, which typically comprises a tapered socket in which an electrical probe is mounted, is intended to be inserted onto the fixed bushing such that a tapered tongue of the bushing enters the socket. In so doing, a conductive tube disposed within the tongue makes electrical connection with the probe, thereby connecting the cable to the fixed bushing.

The elbow terminator is secured to the bushing by means of a latching ring disposed at an inner end of the socket. That latching ring snaps into an annular latching groove formed in the outer periphery of the leading end of the tongue when the elbow terminator is pushed onto the fixed bushing.

The elbow terminator is maneuvered onto the bushing by means of a hand-held shotgun stick which grabs a hook eye affixed to the elbow terminator. It may occur, however, that the tongue does not completely enter the socket, whereby the latching ring does not tightly grip the latching socket. That unlatched condition, which is potentially dangerous, is difficult for the operator to visually detect, especially since the operator will likely be standing remotely (e.g., at least three to five feet) from the terminator and bushing, for safety reasons.

It would therefore be desirable to facilitate the ability of the operator to detect an unlatched condition, especially when standing remotely of the terminator and bushing.

SUMMARY OF THE INVENTION

The present invention relates to the combination of an electrical terminator and an electrical bushing component. The terminator includes a socket, and the bushing component includes a tongue receivable in the socket to electrically interconnect the terminator and bushing. The tongue and socket include a latching arrangement for positively latching the bushing component and terminator together when the tongue enters the socket to a prescribed depth. First and second visual indicators are disposed on outer peripheries of the bushing component and the terminator, respectively. The first and second visual indicators are arranged so that when the terminator is longitudinally inserted onto the bushing, the first and second indicators longitudinally approach one another sufficiently to at least become radially aligned with one another in order to provide a visual indication of positive latching. One of the first and second indicators is situated radially outside of the other of the indicator and is visible when the combination is viewed in a radially inward direction passing through the one indicator.

In another aspect of the invention, an indicator is defined by a color band formed on one of the terminator and bushing component (preferably on the bushing component) and is arranged to be radially covered by an indicator in the form of a covering portion of the other of the terminator and bushing component (preferably the terminator) when the tongue enters the socket to the prescribed depth, thereby providing a visual indication of positive latching.

The present invention also relates to an electrical bushing component which possesses the color band, and also to a method of connecting an electrical terminator to an electrical bushing component which involves causing the color band to be covered when positive latching occurs.

BRIEF DESCRIPTION OF THE DRAWINGS

The objects and advantages of the invention will become apparent from the following detailed description of a preferred embodiment thereof in connection with the accompanying drawings in which like numerals designate like elements and in which:

FIG. 1 is a side elevational view of an elbow terminator and a bushing according to a first preferred embodiment of the invention, in a separated condition, and with the elbow terminator depicted in vertical section;

FIG. 2 is a view similar to FIG. 1 after the terminator has been inserted onto the bushing, a portion of the terminator being broken away;

DETAILED DESCRIPTION OF PREFERRED EMBODIMENTS OF THE INVENTION

Figure 3:
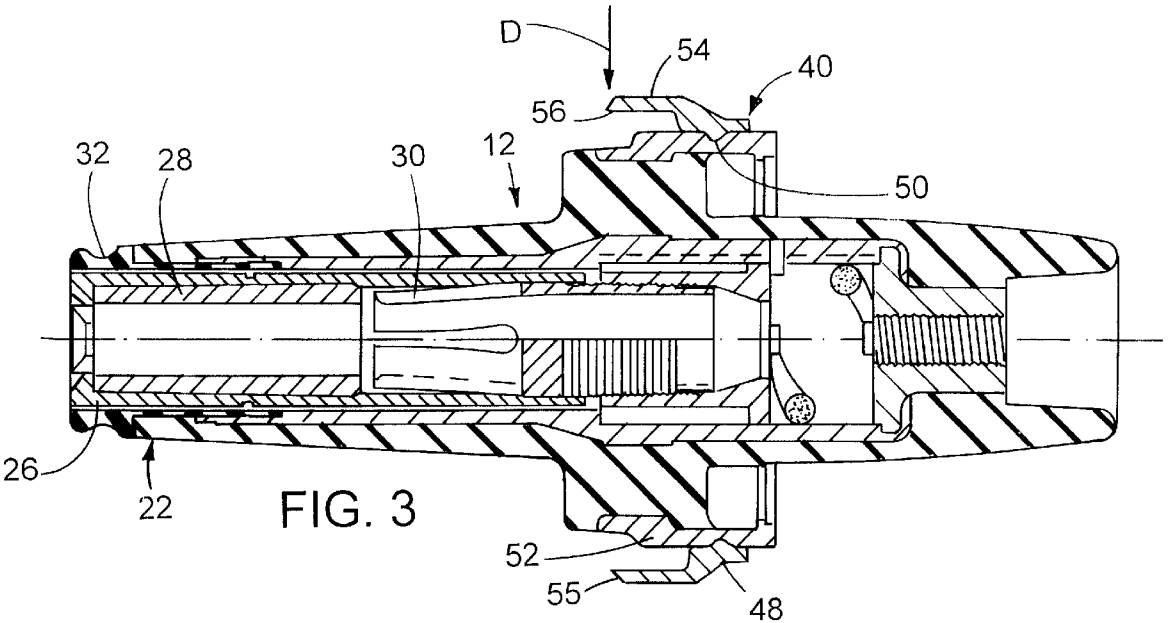
FIG. 3 is a longitudinal sectional view taken through the bushing depicted in FIG. 1.

Depicted in FIG. 1 is a loadbreak elbow terminator 10 and a bushing 12 adapted for connection therewith. The bushing can be of a type which is fixed to a stationary panel such that a tongue 22 is externally exposed. The elbow terminator includes a socket 14 formed in an electrical insulative material 16. The socket 14 includes a tapered portion 13 and merges into a cylindrical portion 15. Extending centrally along the socket is a probe 18 which carries an arc follower 20. The probe 18 is electrically connected to a cable 19.

The tongue 22 is configured to make an interference fit within the socket 14. Adjoining the tongue 22 is a cylindrical enlargement 24 configured to enter the cylindrical portion 15. The tongue 22 is hollow and includes a contact tube 26 (see FIG. 3) in which are disposed an arc interrupter 28 and a contact sleeve 30.

An end of the tongue 22 includes a latching groove 32. When the elbow terminator is pushed onto the bushing 12, the latching groove 32 receives, by snap fit, a latching ring 34 formed on a semiconducting insert 35 at an inner end of the socket 14. In that fashion, the bushing becomes secured to the elbow terminator.

As thus far described, the elbow terminator 10 and bushing 12 are conventional. The elbow terminator is maneuvered onto the bushing 12 by a conventional shotgun stick (not shown) which is manipulated manually by an operator. The shotgun stick includes a hook which grips a hook eye 38 carried by the elbow terminator. As explained earlier, it may occur that the tongue does not fully enter the socket, so that the latching ring 34 does not completely enter the latching groove 32. In that event, the bushing could become dislodged from the elbow terminator 10.

That problem is avoided by the present invention which involves the addition of a visual indicating arrangement which visually indicates when the tongue has entered the socket to a sufficient longitudinal depth to ensure latching. The visual indicating arrangement comprises cooperative visual indicators positioned on the busing and elbow terminator such that the locations of the visual indicators relative to one another in the longitudinal direction is readily visible to the operator. When the visual indicators attain a certain longitudinal relationship, it is ensured that positive latching has occurred. The edge 56 is visible when the bushing 12 is viewed in a radially inward direction D passing through the edge 56, as is evident from FIGS. 3 and 4.

The visual indicators comprise an indicator gauge 40 disposed exteriorly on the bushing 12, and an indicator ring 42 disposed exteriorly on the elbow terminator 10. The indicator ring 42 encircles the outer periphery of the elbow terminal at the entrance to the cylindrical portion 15 and forms a shoulder 44 which defines a mark in the form of an annular edge indicator or witness line 46.

The indicator gauge 40 includes an annular base portion 48 which encircles the outer periphery of the busing at a location remote from the leading end thereof, i.e., remote from the latching groove 32 for the preferred version.

Projecting radially inwardly from an inner diameter of the base portion 48 is an annular ridge 50 configured to snap into a corresponding annular depression formed in the bushing. The semiconductive ground shield 52 could be modified to provide an appropriate surface in which the annular depression can be formed. Alternatively, the semiconductive ground shield 52 could be modified to include the spaced tabs 54 as an integral, i.e., one-piece, part.

Figure 4:
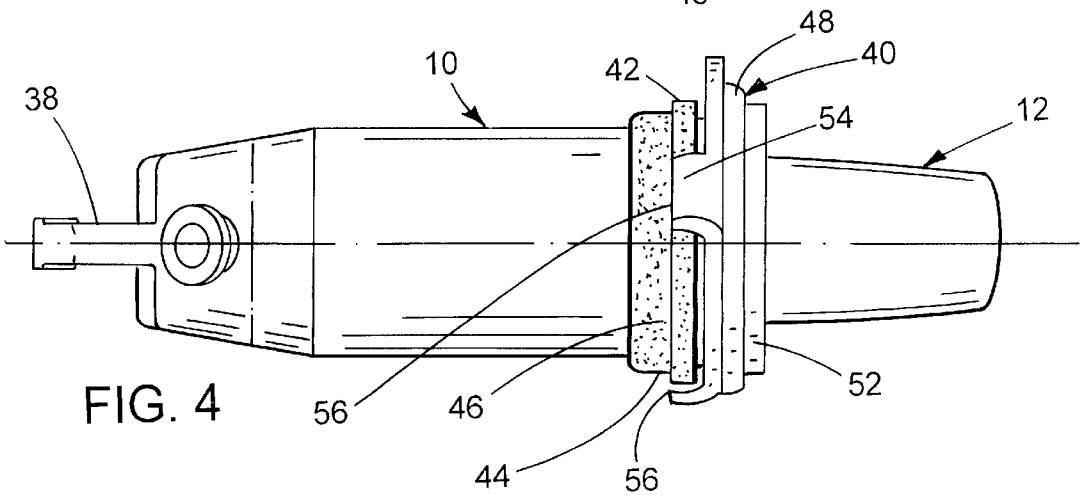
FIG. 4 is a plan view the terminator and bushing after they have been joined together.

Projecting longitudinally from the base 48 is a plurality of circumferentially spaced tabs 54. Each tab 54 includes a beveled free end 55 which defines a mark in the form of a circumferentially extending indicator edge 56 at a radially inner portion of that free end 55. The tabs 54 are of a prescribed length so that when the tongue 22 enters the socket 14 to a longitudinal depth sufficient to ensure positive latching by the latching ring 34 and latching groove 32, the indicator edges 46, 56 will either be radially aligned with one another (as shown in FIG. 4) or pass one another (i.e., the indicator edges 56 would be disposed to the left of the indicator edge 46 in FIG. 4). Thus, an operator can tell, merely by a visual inspection of the relative longitudinal locations of the edges 56, 46 whether positive latching has occurred.

The beveling of the free ends 55 of the tabs makes it easier for the operator to observe the indicator edges 56. By forming the tabs 54 on an annular base 48, the tabs can be conveniently mounted as a unit on the bushing. It will be understood by those skilled in the art that, depending upon the configuration of the outer periphery of the bushing, it may be possible to mold the bushing with tabs in lieu of providing a snap-on base 48 to which the tabs are mounted.

It may also be desirable to reverse the parts, i.e., to provide the gauge tabs 54 on the terminator and provide the indicator ring 42 on the bushing.

The indicator ring 42 could comprise an integral, one-piece portion of the terminator housing, or a separately attached piece.

It may be desirable to color the gauge tabs 54 differently from the indicator ring 42 in order to contrast the edges 46, 56 as much as possible and thereby, facilitate a proper observation by the operator.

While in the disclosed preferred embodiment the indicator gauge 40 is disposed on a bushing, it will be appreciated that the indicator gauge could also be disposed on a bushing insert which is to be mounted to a bushing. Bushings (such as, for example, LBC devices, standoffs, and one-piece bushings) and bushing inserts can be generically referred to as "bushing components".

Figure 5:
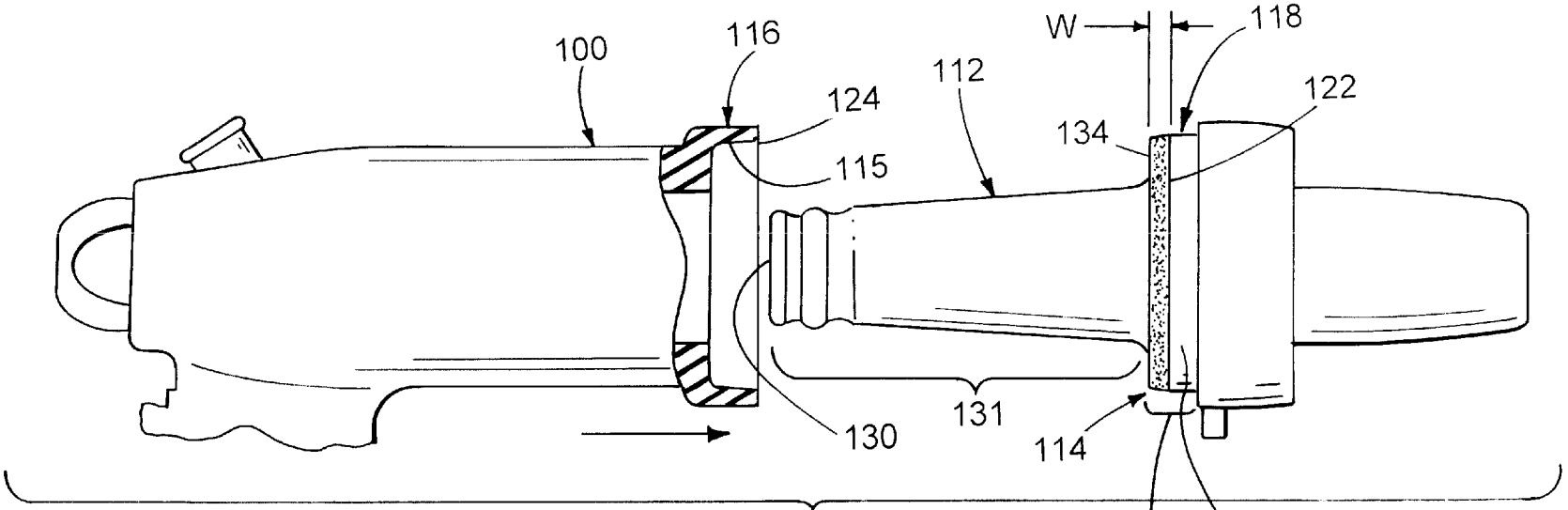
FIG. 5 is a side elevational view of an elbow terminator and a bushing according to a second embodiment of the invention, in a separated condition, and with the elbow terminator partially broken away.
Figure 6:
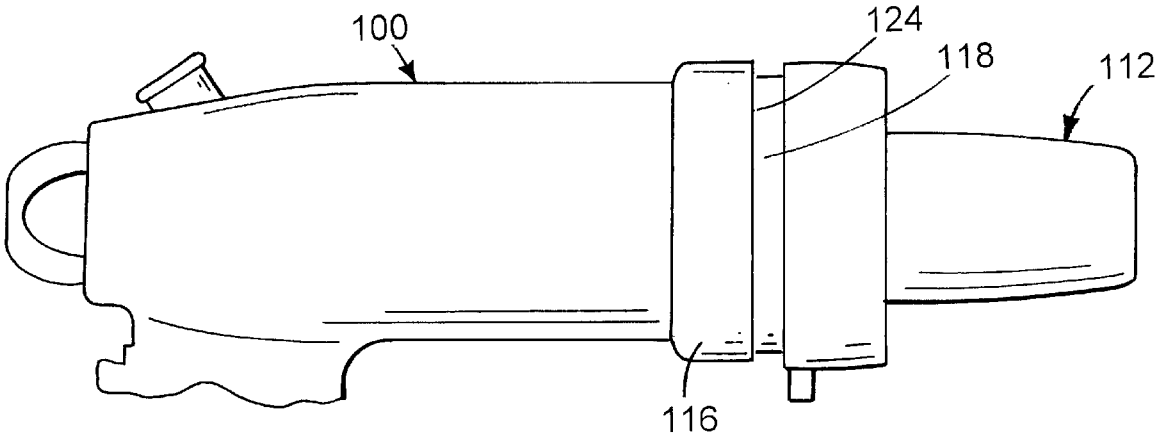
FIG. 6 is a view similar to FIG. 5 of the second embodiment, after the terminator has been inserted onto the bushing.

A second embodiment of the invention, depicted in FIGS. 5 and 6, involves a loadbreak elbow terminator 100 and a bushing 112, wherein a visual indicator or mark 114 is provided on the bushing to cooperate with a visual indicator 116 provided on the terminator. The visual indicator 116 on the terminator is defined by an end portion or end flange of the terminator which surrounds the cylindrical portion 115 of the terminator socket into which a tongue 118 of the bushing is to be inserted.

The visual indicator 114 on the bushing is in the form of an annular color band of width W formed directly on the outer surface of the tongue 118 of the bushing. The color of the band 114 sharply contrasts with that of an adjacent portion 120 of the tongue 118 and also with that of the outer surface of the flange 116. Preferably, the band color is of a highly visible nature, such as a bright dayglow color like yellow, orange, lime green, etc., which is readily visible from at least a three to five foot distance. The color of an adjacent portion of the tongue would be formed of a contrastingly dark color such as brown or gray.

The band 114 forms an edge indicator or witness line 122 at its junction with the adjacent portion 120 of the tongue. Likewise, the end flange 116 of the terminator defines an edge indicator 124.

The relationship between the edge indicators 122, 124 is such that when the terminator is longitudinally inserted onto the bushing sufficiently far for positive latching to occur in the manner described earlier herein, the edge indicators 122, 124 will have longitudinally approached one another sufficiently to be at least radially aligned with one anther. That is, when positive latching has occurred, the color band 114 will be completely disposed within the socket portion 115 and no longer visible.

That indication will be discernable by an operator who views the bushing in a radial direction (i.e., radially with reference to the longitudinal axis thereof), from a distance of at least three to five feet. This enables the operator to maintain a safety distance while determining that latching has occurred.

The color band 114 can be applied in any suitable manner, preferably by applying a colored ink by means of a roller traveling around the outer periphery of the tongue. The band 114 is preferably circumferentially continuous, but it could be interrupted as well, since it is only required that the band be at least partly visible when there is no positive latching, and be invisible when there is positive latching.

The radial distance between the color band 114 and the longitudinal center axis of the tongue is larger than the radial distance between the axis and all portions of the outer circumferential surface of the tongue 118 situated between the color band and a free end 130 of the tongue, as is clear from FIG. 5. As a result, the color band can easily be viewed by an operator who is located to the left of the bushing 112 in FIG. 5 while applying the terminator. In particular, the outer circumferential surface of the tongue 118 includes a first portion 131 extending from the free end 130, and a second portion 132 disposed radially outwardly of the first portion and separated from the first portion by a radial wall 134 of the tongue which is oriented perpendicular to the center axis of the tongue. The color band 114 is disposed flush on the second portion.

Although the present invention has been described in connection with preferred embodiments thereof, it will be appreciated by those skilled in the art that additions, deletions, modification, and substitutions not specifically described may be made without departing from the spirit and scope of the invention as defined in the appended claims.

What is claimed is:

1. In combination, an electrical terminator and an electrical bushing component, said terminator including a socket rigidly fixed thereto, and said bushing component including a tongue receivable in said socket to electrically interconnect said terminator and bushing, said tongue and socket including a latching mechanism for positively latching said bushing component and terminator together when said tongue longitudinally enters said socket to a prescribed depth, a color band formed flush on a portion of an outer circumferential surface of said tongue, said portion arranged to enter said socket and be radially covered completely by a covering portion of said socket when said tongue enters said socket to said prescribed length to provide a visual indication of positive latching, said tongue including a longitudinal center axis and a longitudinal free end which constitutes an initial portion of said tongue to enter said socket; said portion of said outer circumferential surface on which said color band is disposed flush being spaced longitudinally from said free end and being spaced radially from said longitudinal axis by a first radial distance, and wherein all other portions of said outer circumferential surface disposed between said color band and said free end being spaced radially from the center axis by a radial spacing no larger than said first radial distance.

2. The combination according to claim 1 wherein said first radial distance is larger than said radial spacing of all portions of said outer circumferential surface disposed between said color band and said free end.

3. The combination according to claim 1 wherein said outer circumferential surface includes a first portion extending from said free end, and a second portion spaced radially outwardly from said first portion by a radial surface of said tongue oriented perpendicular to said center axis, said second portion defining said portion of said outer circumferential surface on which said color band is disposed.

* * * * *

US006504103C1

(12) EX PARTE REEXAMINATION CERTIFICATE (9512th)

United States Patent
Meyer et al.

(10) Number: US 6,504,103 C1
(45) Certificate Issued: Feb. 14, 2013

(54) VISUAL LATCHING INDICATOR ARRANGEMENT FOR AN ELECTRICAL BUSHING AND TERMINATOR

(75) Inventors: Andrew Edgar Meyer, Milwaukee, WI (US); Todd Kim Knapp, Waukesha, WI (US); Frank John Muench, Waukesha, WI (US)

(73) Assignee: Cooper Technologies Company, Houston, TX (US)

Reexamination Request:
No. 90/008,386, Dec. 21, 2006

Reexamination Certificate for:

| | |
|---|---|
| Patent No.: | **6,504,103** |
| Issued: | **Jan. 7, 2003** |
| Appl. No.: | **08/821,760** |
| Filed: | **Mar. 20, 1997** |

Related U.S. Application Data

(63) Continuation of application No. 08/262,460, filed on Jun. 20, 1994, now abandoned, which is a continuation-in-part of application No. 08/038,335, filed on Mar. 19, 1993, now abandoned.

(51) Int. Cl.

| | |
|---|---|
| ***H01R 11/28*** | (2006.01) |
| ***H01R 11/11*** | (2006.01) |
| *H01R 13/641* | (2006.01) |
| *H01R 13/64* | (2006.01) |

(52) U.S. Cl. ..... 174/167; 285/93; 439/489; 439/680

(58) Field of Classification Search ..... None
See application file for complete search history.

(56) References Cited

To view the complete listing of prior art documents cited during the proceeding for Reexamination Control Number 90/008,386, please refer to the USPTO's public Patent Application Information Retrieval (PAIR) system under the Display References tab.

*Primary Examiner* — Roland Foster

(57) ABSTRACT

An elbow terminator has a socket in which an electrical probe is disposed. The terminator is insertable onto an electrical bushing such that a tongue of the bushing is received in the socket of the terminator, and the probe of the terminator is electrically coupled to a contact sleeve disposed within the tongue. A latching mechanism produces positive latching between the tongue and socket when the tongue has been inserted to a predescribed depth within the socket. In order to enable an operator to visually observe that the tongue has been inserted to the prescribed depth, the bushing carries a color band which becomes completely disposed (invisible) in the socket when positive latching occurs. Alternatively, the bushing can be provided with gauge tabs which become aligned with a witness line formed on the terminator when positive latching occurs.

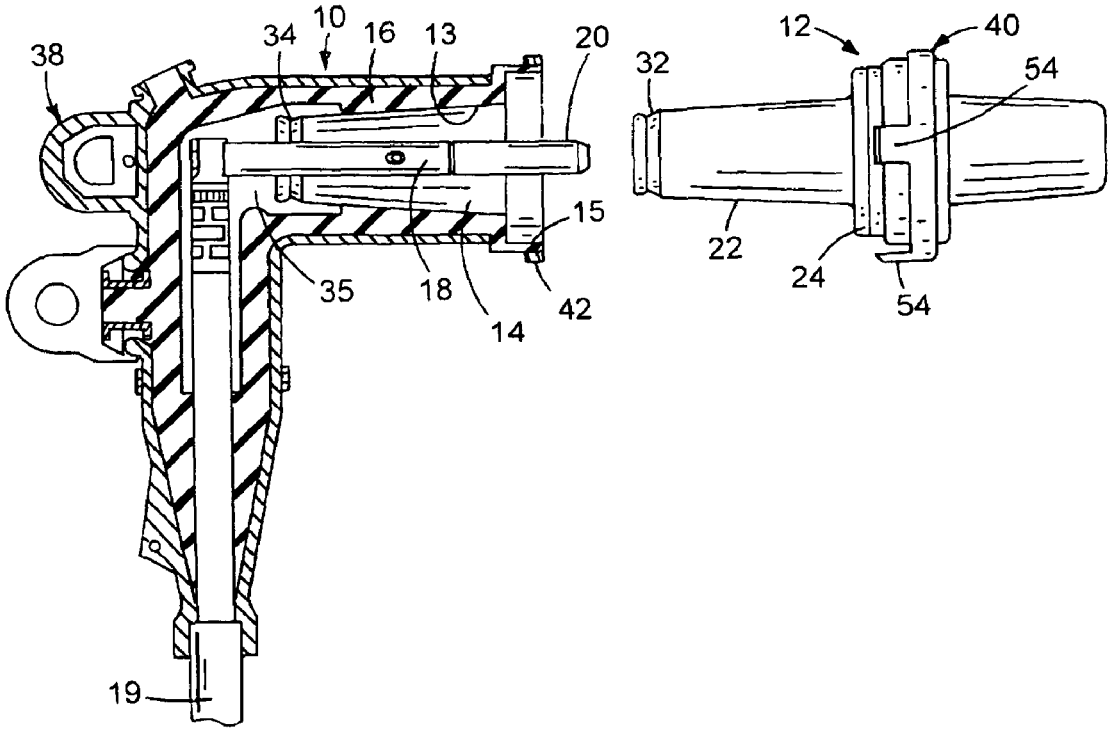

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-3 are cancelled.

* * * * *